US005119937A

United States Patent [19]

Reynolds, Jr.

[11] Patent Number: 5,119,937

[45] Date of Patent: Jun. 9, 1992

[54] CHAIN SAW CASE

[75] Inventor: Donald R. Reynolds, Jr., Raleigh, N.C.

[73] Assignee: Southern Case, Inc., Raleigh, N.C.

[21] Appl. No.: 717,920

[22] Filed: Jun. 20, 1991

[51] Int. Cl.[5] ..... B27B 17/00; B65D 85/00

[52] U.S. Cl. ..... 206/349; 206/493; 206/564

[58] Field of Search ..... 206/349, 320, 486, 487, 206/488, 493, 564; 30/151, 382

[56] References Cited

U.S. PATENT DOCUMENTS

| | | | |
|---|---|---|---|
| 3,339,781 | 9/1967 | Schurman et al. | 206/349 X |
| 3,344,818 | 10/1967 | Musgrove | 30/151 X |
| 3,933,243 | 1/1976 | Schurman | 206/349 |
| 4,162,004 | 7/1979 | Thomas | 206/349 |
| 4,369,575 | 1/1983 | Schurman | 206/349 |
| 4,371,079 | 2/1983 | Dembicks | 206/349 |
| 4,473,176 | 9/1984 | Harper | 206/349 X |
| 4,621,426 | 11/1986 | Shivers | 30/382 |

*Primary Examiner*—Paul T. Sewell
*Assistant Examiner*—Jacob K. Ackun, Jr.
*Attorney, Agent, or Firm*—Bell, Seltzer, Park & Gibson

[57] ABSTRACT

A tray-like open-top base member of the case closely receives the lower portion of a chain saw upon downward movement of the saw into case base member, and automatically and releasably connects to the chain saw by resilient detent elements. Upward movement of the chain saw relative to the case base member automatic effects release of the detent elements. Tools and other articles used for operation or maintenance of the chain saw are stored within open-top storage compartments in the bottom of the case base member. The articles are retained within the compartments by the overlying main body of the chain saw, when the chain saw and case base member are interconnected, and some of the articles are also retained in their compartments by additional detent elements. A scabbard is releasably retained upon the cutting chain assembly of the chain saw by ribs that engage the opposite sides of the assembly, and by a flange upon the inner end of the scabbard. Removal of the scabbard from the cutting chain assembly can be effected by preliminary upward movement of the inner end of the scabbard, followed by longitudinal movement thereof away from the case base member, while the case base member and the chain saw are interconnected. The case and its detent elements are preferably made of blow molded plastic material.

12 Claims, 5 Drawing Sheets

CHAIN SAW CASE

FIELD OF THE INVENTION

This invention relates to protective and supportive cases for portable chain saws and the like, and more particularly relates to an improved chain saw case of the "tote" type which includes an open-top tray-like base member that receives and releasably interconnects with the lower portion of the housing of the chain saw; and that also receives accessory items, such as tools and a spare saw chain, needed for operation and/or maintenance of the saw. The case may also include a protective scabbard member for the elongate toothed cutting chain of the saw.

BACKGROUND OF THE INVENTION

A chain saw case of the general type described above has heretofore been proposed. Establishment and release of the connection between the saw and the base member of the prior-art case requires combined vertical, lateral and tilting moving of the saw, and also manual manipulation of a pivotally movable latch. The scabbard cannot be removed from the cutting chain while the saw and case are interconnected, even though scabbard removal at other times, for purposes of inspection or maintenance of the chain, would be desirable. Additionally, operator access to the interior of an accessory article storage compartment of the base member of the prior case is not as convenient as desired.

SUMMARY OF THE INVENTION

The case of the present invention includes an upwardly-opening, tray-like base member that receives the lower portion of the housing of the chain saw. The case also includes a scabbard member that is insertable upon and removable from the cutting chain of the saw. Resilient detent means within the base member engage portions of the housing and automatically connect the saw and the base member together in response to downward movement of the saw into the base member. The aforesaid interconnection effected by the detent means automatically releases in response to movement of the chain saw upwardly relative to the base member. The bottom wall of the base member includes at least one and preferably a plurality of open-top recesses that form storage compartments for articles used for maintenance of the saw. When the chain saw and base member are interconnected, the chain saw overlies the aforesaid compartments and prevents inadvertent displacement of the articles from them. Removal of the chain saw from the base member affords easy access to the articles in the compartments.

The scabbard member of the case has a flanged inner end portion that normally retains the scabbard in place upon the endless chain of the saw when the saw and base member are interconnected, but which may be removed from the cutting chain, while the saw and base member are interconnected, when one imparts preliminary upward movement to the aforesaid end portion of the scabbard.

In addition to the detents that interconnect the chain saw and the base member, additional detents may be and preferably are provided in at least some of the storage compartments for assisting in releasably retaining articles stored therein.

DESCRIPTION OF THE PRIOR ART

U.S. Pat. No. 4,369,575 discloses a "tote" type case for a chain saw, which case includes an open top base member that receives the lower portion of the saw, and a scabbard member that receives the endless cutting chain of the saw.

DESCRIPTION OF THE DRAWINGS

Other features of the invention will be apparent from the following description of an illustrative embodiment thereof, which should be read in conjunction with the accompanying drawings, in which.

DESCRIPTION OF THE PREFERRED EMBODIMENT

Figures 1, 2:
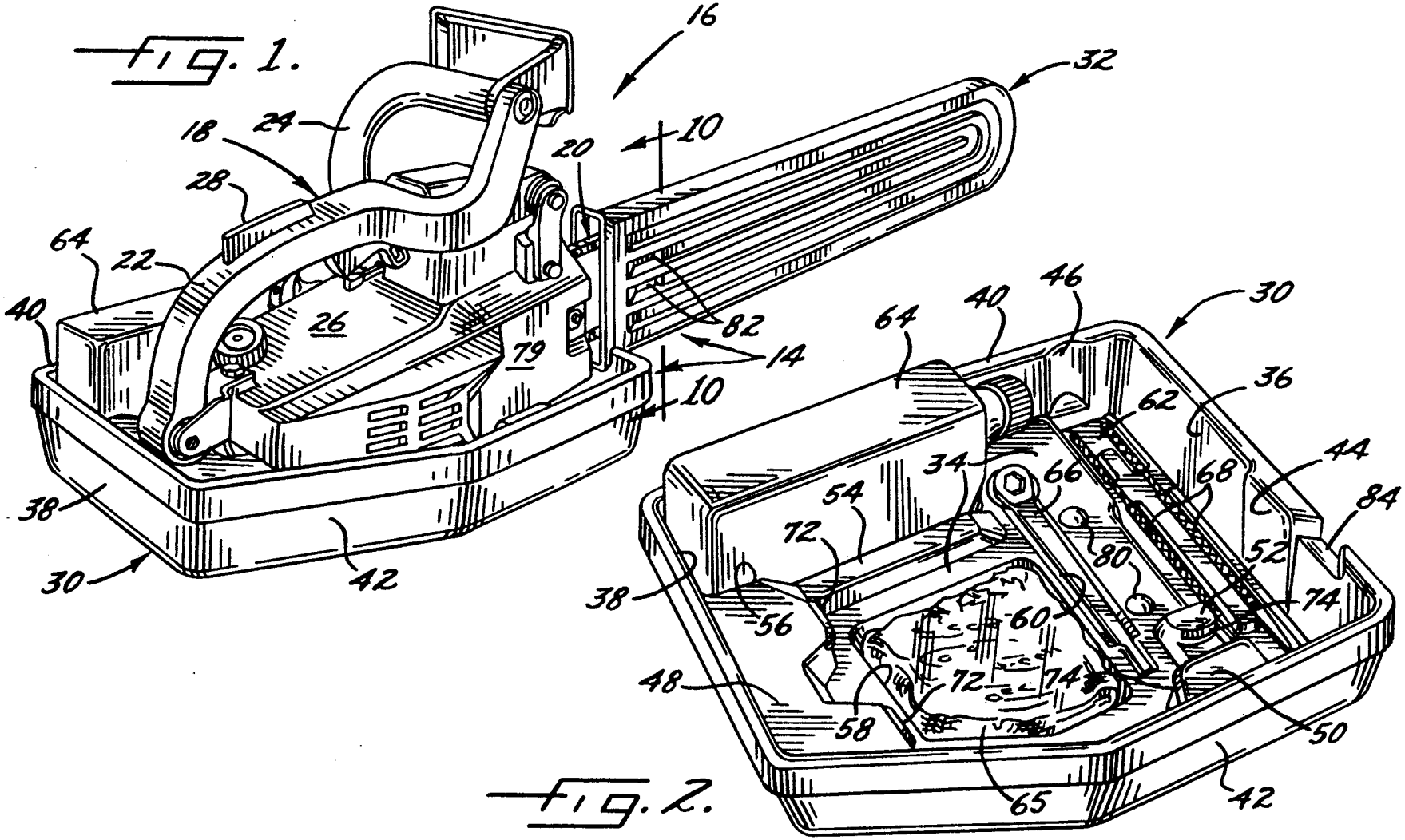
FIG. 1 is a top right perspective view of a case in accordance with the invention, and of a chain saw supported within and connected to the case base member, and having a scabbard member of the case upon the cutting chain of the saw.
FIG. 2 is a top right perspective view of the case base member, and of articles within storage compartments thereof.
Figure 3:
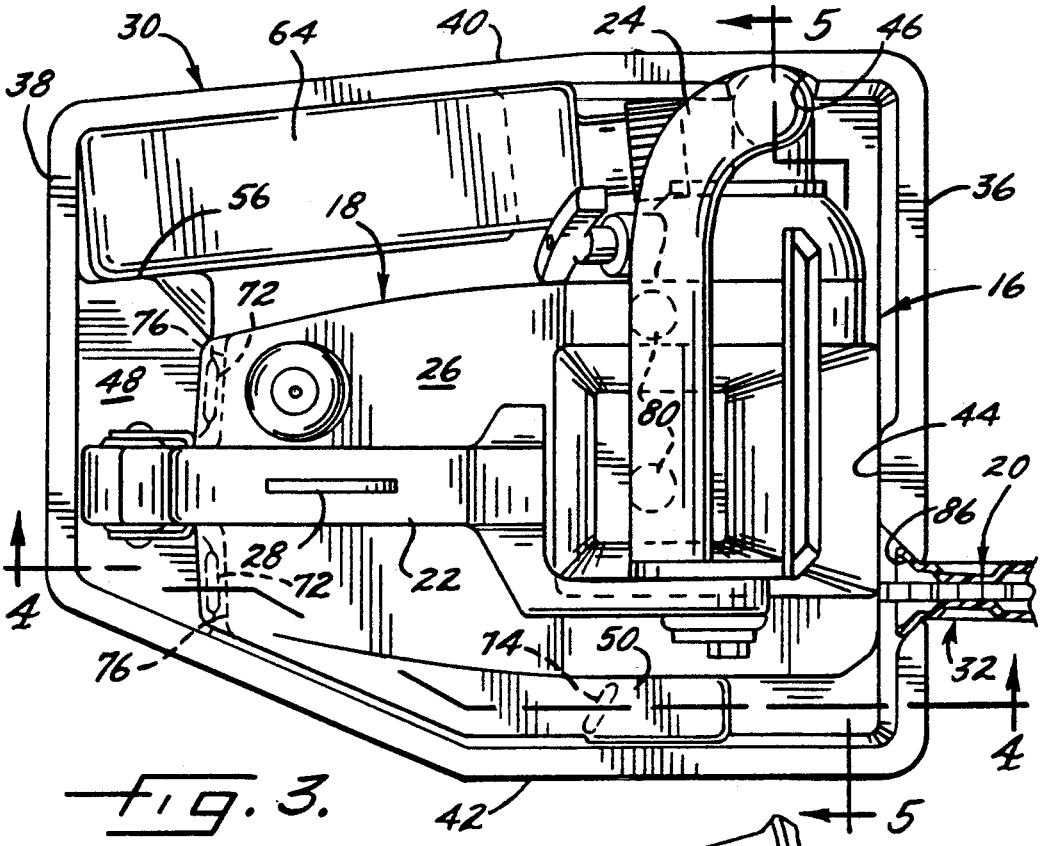
FIG. 3 is a top plan view of the case base member and of the main body of the chain saw therewithin, fragmentary portions of the cutting chain and case scabbard member also being shown.
Figure 4:
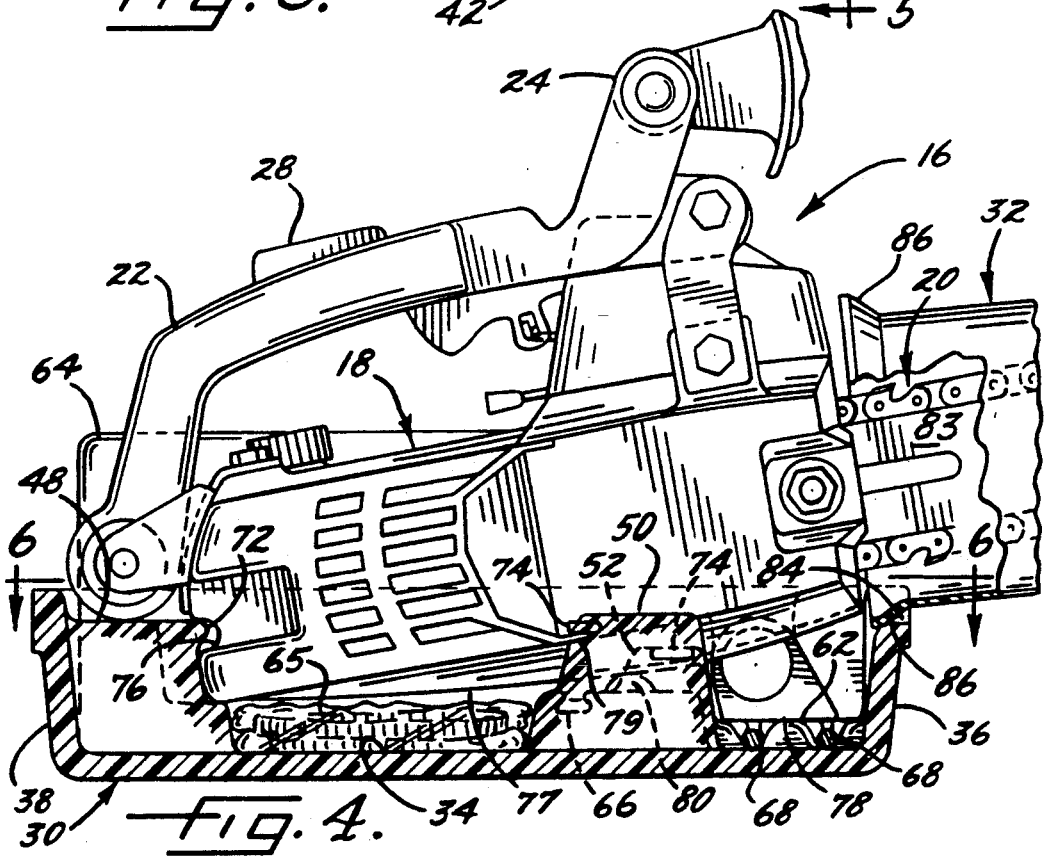
FIG. 4 is a vertical section taken through the case base member substantially along the line and in the direction of the arrows 4—4 of FIG. 3, components of the chain saw and articles within the case also being shown, together with a partially broken-away inner end portion of the scabbard member of the case.

The numeral 14 in FIG. 1 designates a two-part case for a conventional chain saw 16 having a main body 18 and an endless toothed saw chain 20 extending forwardly therefrom. Saw 16 is of a conventional construction, having drive means within its main body for driving cutting chain 20, having handles 22, 24 by which the saw can be lifted and manipulated, a fuel reservoir 26, a control lever 28 and other conventional components.

Case 14 includes an open-top, tray-like base member 30, and an elongate sheath member 32. Members 30, 32 may be and preferably are formed of blow-molded durable plastic material, and base member 30 is preferably and illustratively of hollow-wall construction.

Base member 30 is adapted to closely receive the lower portion of chain saw main body 18 when the chain saw is moved vertically downwardly into member 30. Member 30 has a bottom wall 34 that supportively engages bottom surfaces of body 18, and also has peripheral upstanding front and rear walls 36, 38, and opposite side walls 40, 42. Lateral and longitudinal movement of main body 18 of saw 16 is restrained by generally vertically extending abutment surfaces of base member 30. These include a surface 44 upon front wall 36, a curved handle-engaging surface 46 upon side wall 40, and those upstanding surfaces of raised pad-like sections 48, 50, 52 and 54 that are closely adjacent thereto confronting surfaces of body 18 when the lower portion of saw 16 is seated within base member 30.

Figure 8:
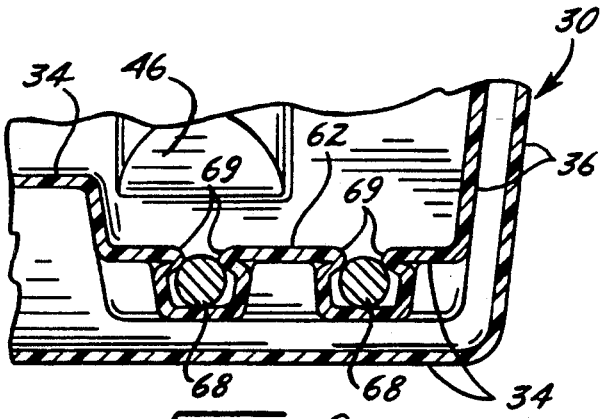
FIG. 8 is an enlarged fragmentary sectional view taken substantially along the line and in the direction of the arrows 8—8 of FIG. 6, showing files retained by detents within a storage compartment of the base members.
Figure 9:
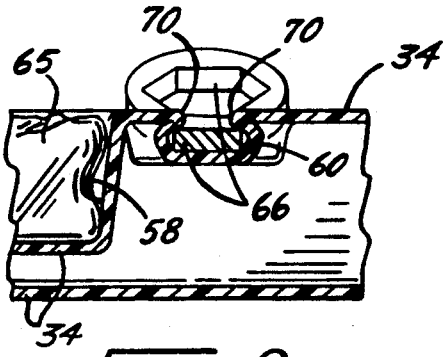
FIG. 9 is a sectional view taken substantially along the line and in the direction of the arrows 9—9 of FIG. 6, showing a tool retained by detents within a storage compartment of the case base member.

Bottom wall 34 also has a plurality of recesses that define upwardly-opening article storage compartments 56, 58, 60 and 62. Compartment 56 receives a container 64 containing fluid, e.g., oil, for saw 16. Compartments 58, 60, 62 contain other articles used in the operation or maintenance of the saw, illustratively a replacement saw chain 65, a wrench-type tool 66, and a pair of files 68 for sharpening the teeth upon the toothed cutting chain of the saw, respectively. The latter three compartments are closely overlaid by the lower portions 77 or 78 of the main body 18 of saw 16 when the saw is seated within base member 30. This prevents inadvertent passage of the articles from the compartments. Additionally, detent means are provided within compartments 60, 62 for further releasably retaining the tool articles contained therein. The aforesaid detent means includes detent elements 69 (best shown in FIG. 8) within file compartment 62, and detent elements 70 (best shown in FIG. 9) within wrench compartment 60. It will of course be appreciated that all of the articles within the aforesaid storage compartments are readily accessible for removal and use when saw 16 is not seated within base member 30.

Figure 5:
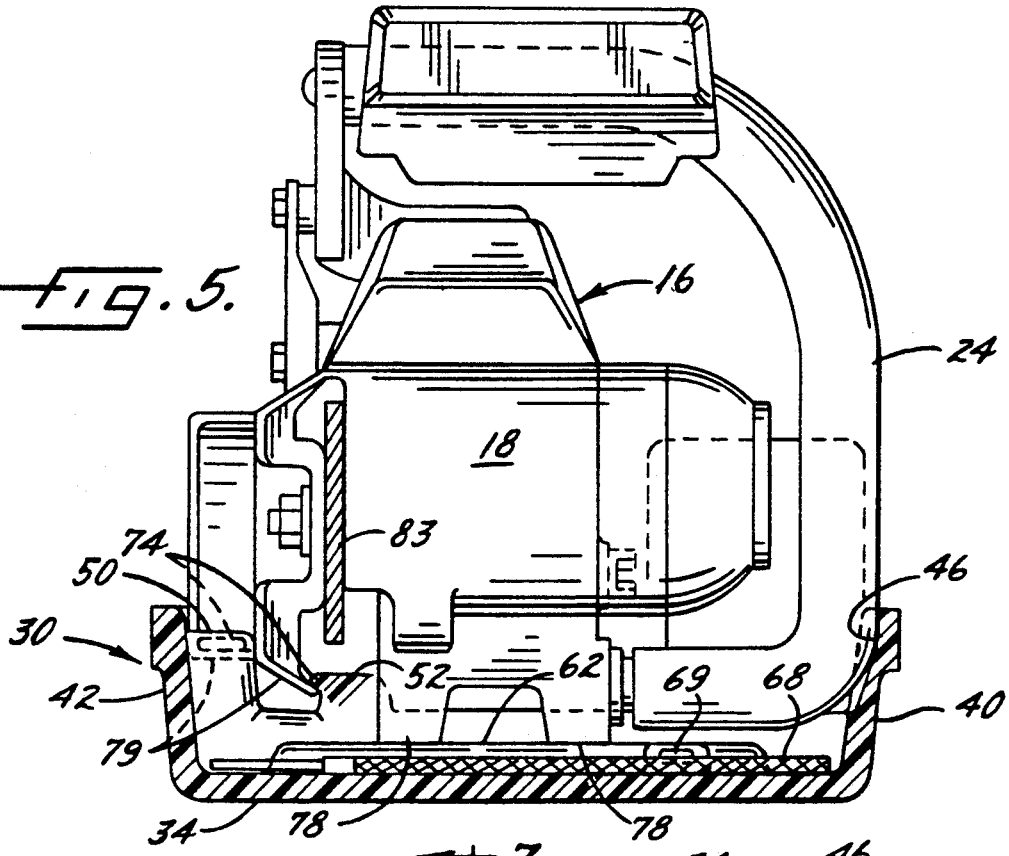
FIG. 5 is a vertical section taken substantially along the line and in the direction of the arrows 5—5 of FIG. 3, and showing in front elevation the components of the chain saw and an article within a storage compartment of the base member of the case.

In addition to the detent means discussed above and associated with storage compartments 60, 62, base member also has other detent means that securely interconnect saw 16 and case base member 30 when the saw is moved downwardly into seated relationship with member 30. The aforesaid interconnection is such that member 30 and saw 16 can be readily transported as a unit by a person grasping one of the handles 22, 24 of the saw. When it is desired to remove saw 16 from the case base member 30, this can be quickly and easily effected since the aforesaid detent means automatically releases in response to upward movement of the saw relative to member 30, or downward movement of member 30 relative to the saw. The detent means for achieving the foregoing highly desirable result illustratively includes a set of longitudinally aligned detent elements 72 upon pad-like section 48 of the case, and a second set of detent elements 74 upon the raised pad-like sections 50, 52 adjacent the front and right side walls of member 30. Elements 74 extend in angular relationship to each other, and to the detent elements 72. When saw 16 is not seated within base member 30 detent elements 72 occupy their extended positions shown in FIG. 2 and wherein they project outwardly from case section 48. Detent elements 74 also then occupy their extended positions wherein they project outwardly from the pad-like base member sections 50, 52 with which they are associated. During initial downward movement thereof into base member 30, saw 16 engages detent elements 72, 74 and forces the same inwardly to retracted positions which permit continued downward movement of saw 16 into base member 30. When the continued downward movement of saw 16 seats saw body 18 within base member 30, detent elements 72 are aligned with a groove 76 within the rear portion of chain saw body 18 and undergo resilient return outward movement into groove 76. At substantially the same time, detent elements 74 similarly undergo resilient outward return movement to their extended positions (best shown in FIG. 5), wherein they engage and impose resilient retaining forces upon thereto confronting sections of an outer wall 79 of saw body 18. Initial upward movement of saw 16 from case 14 displaces detents 72, 74 inwardly to their retracted positions, which permits continued upward movement of the saw relative to and from base member 30. All of the detent elements of base member 30 of case 14 preferably and illustratively are formed integrally with and of the same plastic material as case base member 30. The inherent resiliency of such material allows the detent elements to undergo the movement, between retracted and extended positions and necessary for performance of their intended function, without the use of metal springs or the like.

Figure 6:
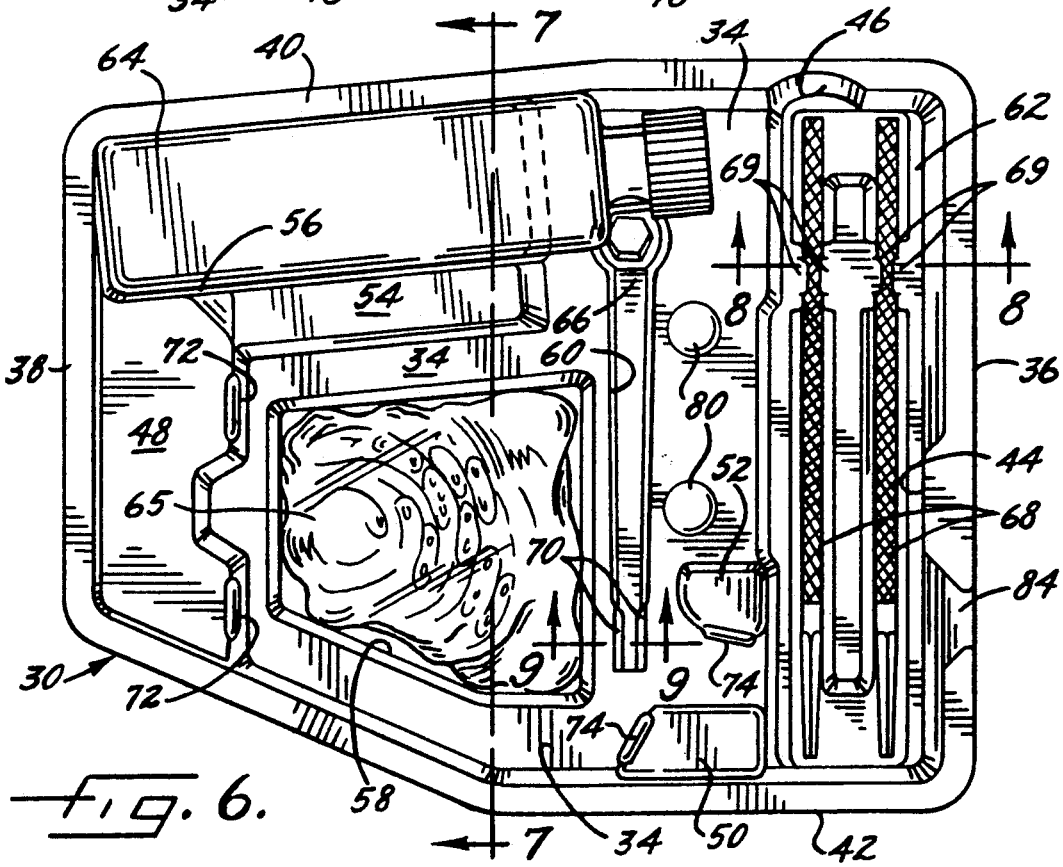
FIG. 6 is a top plan view taken substantially along the line and in the direction of the arrows 6—6 of FIG. 4 showing articles within storage compartments of the case, and showing in phantom lines supportive foot elements of the chain saw, the inner end portion of the scabbard member of the case also being fragmentarily shown.
Figure 7:
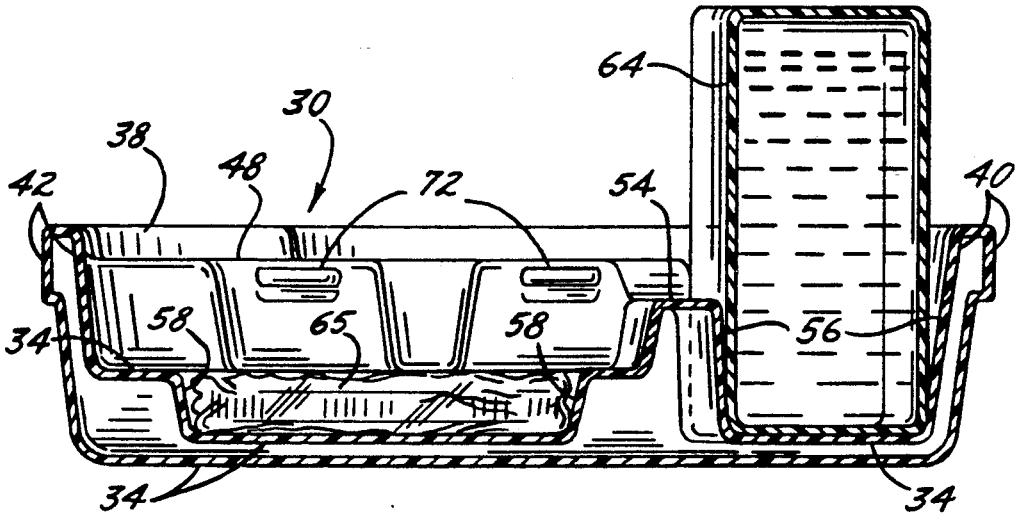
FIG. 7 is a vertical section taken substantially along the line and in the direction of the arrows 7—7 of FIG. 6 through the case base member and a container therewithin.

A pair of laterally spaced convex elements 80 (FIGS. 2 and 6) are formed integrally with and project upwardly from that portion of bottom wall 34 intermediate storage compartments 60, 62. Elements 80 compensate for slight difference in height of the main body portion of different models of saw 16. In keeping with the previously described detent elements, elements 80 are preferably and illustratively formed integrally and with the same plastic material as the case base member 30.

Figure 10:
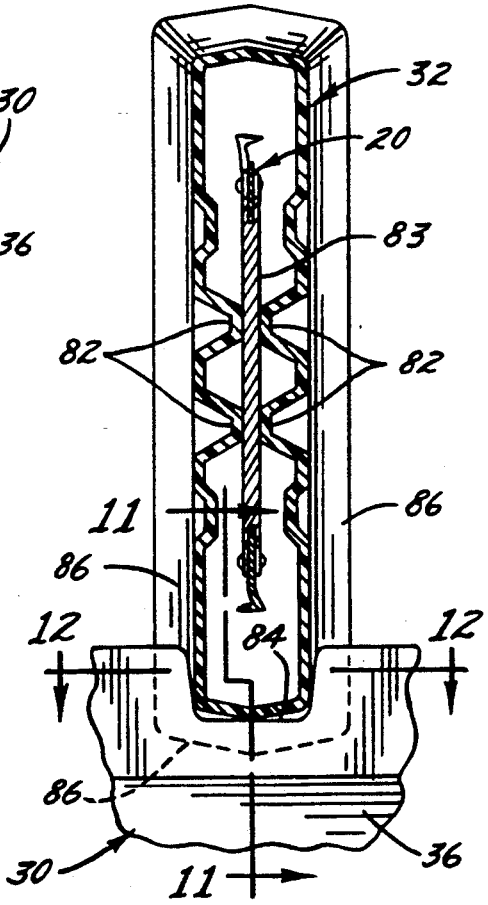
FIG. 10 is a sectional view taken substantially along the line and in the direction of the arrows 10—10 of FIG. 1 through the scabbard member of the case and through the cutting chain of the saw, and also showing in front elevation a notch within the front wall of the base member of the case.
Figure 11:
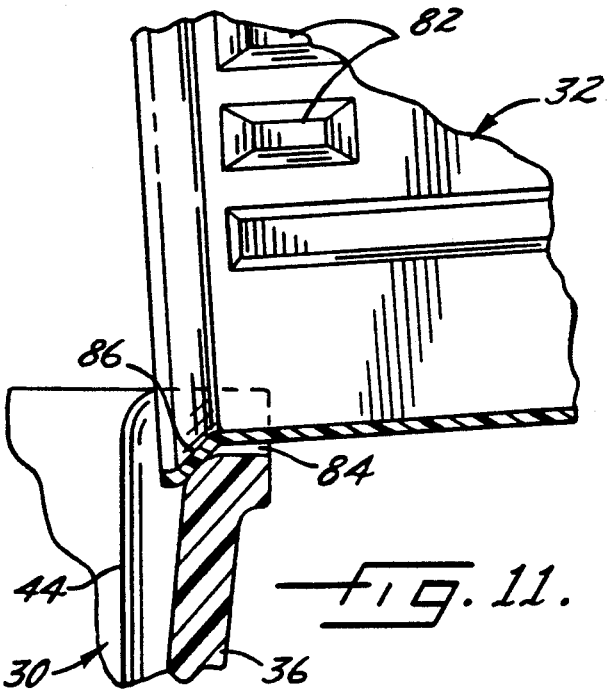
FIG. 11 is a fragmentary sectional view taken substantially along the line and in the direction of the arrows 11—11 of FIG. 10 through the inner end portion of the scabbard member of the case, and through a notched portion of the front wall of the base member of the case.
Figure 12:
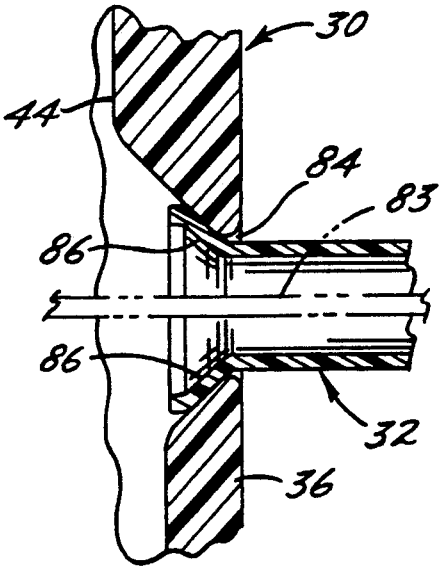
FIG. 12 is a fragmentary sectional view taken along the line and in the direction of the arrows 12—12 of FIG. 10 through the inner end portion of the scabbard member and through the notched portion of the front wall of the base member of the case.
Figure 13:
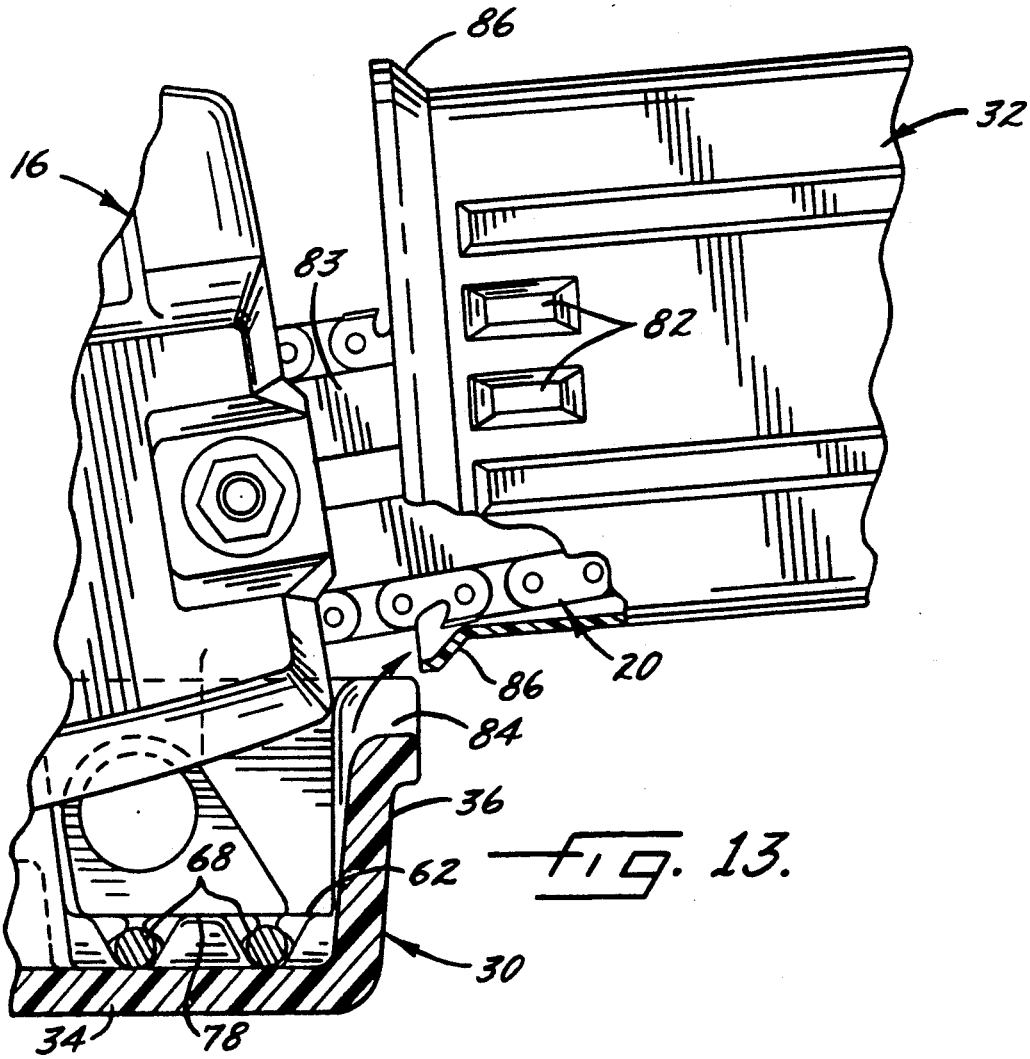
FIG. 13 is a fragmentary view, partially in vertical section and partially in side elevation illustrating disengagement of the scabbard member of the case from the base member while the chain saw and case base member are interconnected.

The scabbard member 32 also illustratively forming part of case 14 is of elongate hollow construction. A plurality of inwardly extending ribs 82 engage opposite sides of the central support bar 83 of the elongate cutting chain assembly and assist in releasably retaining scabbard 32 upon the assembly. As shown in FIGS. 10–12, the bottom of the open inner end portion of scabbard 32 normally rests upon the bottom of a notch-like opening 84 within front wall 36 of case base member 30, and a flange 86 extending angularly from the inner end of member 32 normally engages the rear surface of that part of front wall 36 adjacent opening 84. This further assists in preventing inadvertent displacement of scabbard 32 from the cutting chain assembly while chain saw 16 is seated within case base member 30. It is sometimes desirable, however, for the cutting chain assembly 20 to be exposed, as for purposes of inspection or repair, while saw 16 is seated within case member 30. This can be readily accomplished simply by moving the inner end portion of scabbard 32 upwardly to the limited extent necessary for flange 86 to pass over the notched portion 84 of front wall 36 of case base member 30 (as best shown in FIG. 13), and then moving scabbard 32 forwardly from the cutting chain assembly. Replacement of the scabbard upon the cutting chain assembly is accomplished with equal facility by sliding it rearwardly upon the cutting chain assembly, raising the rear end of scabbard 32 sufficiently to allow it to clear the notched portion of front wall 36 of case base member 30, and then releasing the rear end portion of the scabbard.

While a preferred embodiment of the invention has been shown and described, the was for purposes of illustration only, and not for purposes of limitation, the scope of the invention being in accordance with the following claims.

I claim:

1. A supportive and protective case for a chain saw and accessory items; said chain saw having a housing, a handle connected to said housing, and an elongate toothed saw chain extending forwardly from said housing; said device comprising:

an upwardly-opening, tray-like base member, said base member including a bottom wall and front, rear, and side walls extending upwardly from said bottom wall;

said bottom wall of said housing having a plurality of recessed open-top article storage compartments therein;

resilient detent means within said base member for, in response to downward movement of said chain saw into said base member, engaging sections of said housing and automatically connecting said chain saw and said base member for vertical and other movement of a unit; and for automatically releasing the connection between said chain saw and said base member upon upward movement of said chain saw relative to said base member without manipulation of a latch mechanism, whereby said chain saw and said base member are automatically connected to each other by downward movement of said chain saw into said base member and are automatically disconnected from each other by upward movement of said chain saw relative to said base member.

2. A case as in claim 1, wherein said housing of said chain saw overlies said storage compartments of said base member and forms a closure for said storage compartments when said chain saw and said base member are interconnected by said detent means.

3. A case as in claim 2, wherein said detent means includes a set of detent elements adjacent one end of said base member.

4. A case as in claim 3, wherein said detent elements extend in generally aligned relationship to each other.

5. A case as in claim 4, wherein said detent means includes a second set of detent elements adjacent an end of said base member distal from said first-mentioned end thereof.

6. A case as in claim 5, wherein said detent elements of said second set extend in angular relationship to each other.

7. A case as in claim 6, wherein said detent elements of said first-mentioned set extend in angular relationship to said detent elements of said second set.

8. A case as in claim 7, wherein said article storage compartments include a first compartment for storing a toothed saw chain, and a second compartment for storing a file, and a third compartment for storing a wrench.

9. A case as in claim 8, and further including article retaining detent means within at least one of said article storage compartments for releasably retaining a stored article therein.

10. A case as in claim 9, wherein said base member has generally vertically extending abutment surfaces engageable with confronting surfaces of said chain saw and restricting lateral and longitudinal movement between said chain saw and said base member.

11. A case as in claim 10, wherein said tray-like base member of said case is formed of blow-molded thermoplastic material, and at least some of said walls thereof are of hollow construction.

12. A case as in any of the preceding claims, and further including an elongate hollow scabbard having an inner end and an outer end, said scabbard being insertable upon and removable from said toothed chain of said saw; said scabbard having a flange adjacent said inner end thereof, and said front wall of said base member having an upwardly opening notch through which said toothed chain and the inner end portion of said scabbard-like member extend, said flange and said notch having confronting surfaces preventing inadvertent movement of said inner end portion of said scabbard forwardly through said notch, said inner end of said scabbard being upwardly movable to an extent permitting passage of said flange through said notch and movement of said scabbard from and onto said toothed chain while said chain saw and said base member are connected to each other by said first-mentioned detent means.

* * * * *